US007905046B2

(12) United States Patent
Smith, III

(10) Patent No.: US 7,905,046 B2
(45) Date of Patent: Mar. 15, 2011

(54) SYSTEM AND METHOD FOR DETERMINING TARGET RANGE AND COORDINATING TEAM FIRE

(75) Inventor: Thomas D. Smith, III, Oklahoma City, OK (US)

(73) Assignee: Thomas D. Smith, III, Oklahoma City, OK (US)

( * ) Notice: Subject to any disclaimer, the term of this patent is extended or adjusted under 35 U.S.C. 154(b) by 0 days.

(21) Appl. No.: 12/043,875

(22) Filed: Mar. 6, 2008

(65) Prior Publication Data

US 2009/0205239 A1 Aug. 20, 2009

Related U.S. Application Data

(60) Provisional application No. 61/029,203, filed on Feb. 15, 2008.

(51) Int. Cl.
*F41G 1/00* (2006.01)

(52) U.S. Cl. ..... 42/142; 42/144; 42/122; 42/130; 235/404; 89/41.17; 89/41.19; 89/204

(58) Field of Classification Search ..... None
See application file for complete search history.

(56) References Cited

U.S. PATENT DOCUMENTS

| | | | | | |
|---|---|---|---|---|---|
| 3,392,450 | A * | 7/1968 | Herter et al. | 42/122 |
| 4,229,103 | A * | 10/1980 | Hipp | 356/141.1 |
| 4,263,719 | A * | 4/1981 | Murdoch | 33/297 |
| 4,336,018 | A | 6/1982 | Marshall et al. | |
| 4,352,665 | A | 10/1982 | Kimble et al. | |
| 4,380,437 | A | 4/1983 | Yarborough, Jr. | |
| 4,531,052 | A * | 7/1985 | Moore | 235/404 |
| 4,583,950 | A | 4/1986 | Schroeder | |
| 4,619,616 | A | 10/1986 | Clarke | |
| 4,680,012 | A | 7/1987 | Morley et al. | |
| 4,777,352 | A * | 10/1988 | Moore | 235/404 |
| 4,787,739 | A * | 11/1988 | Gregory | 356/4.03 |
| 4,923,402 | A | 5/1990 | Marshall et al. | |
| 5,189,560 | A * | 2/1993 | Edwards et al. | 359/744 |
| 5,616,903 | A * | 4/1997 | Springer | 235/414 |
| 6,322,365 | B1 | 11/2001 | Schechter et al. | |
| 6,636,296 | B1 | 10/2003 | Faulkner et al. | |
| 6,681,512 | B2 * | 1/2004 | Sammut | 42/122 |
| 7,421,816 | B2 * | 9/2008 | Conescu | 42/122 |
| 2002/0139030 | A1 * | 10/2002 | Smith | 42/122 |
| 2004/0016168 | A1 * | 1/2004 | Thomas et al. | 42/122 |
| 2005/0213962 | A1 * | 9/2005 | Gordon | 396/502 |
| 2005/0257414 | A1 * | 11/2005 | Zaderey et al. | 42/122 |

(Continued)

OTHER PUBLICATIONS

Leupold, "Ranging System for the Tactical Milling Reticle—Operating Instructions", Leupold & Stevens, Inc. Beaverton, OR, retrieved on Jun. 6, 2008 from http://www2.leupold.com/resources/downloads.htm.

(Continued)

*Primary Examiner* — Troy Chambers
*Assistant Examiner* — Samir Abdosh

(57) ABSTRACT

A system and method for use of an enhanced aiming system which includes a marker displayed at a first position in an aiming scope, a user input of a start position and an ending position to measure a desired impact zone, a calculator for determining a range to the target based on the known dimension of the impact zone and the magnification value of the aiming scope, and a display in the aiming scope for showing an aiming point dot or bar to compensate for projectile drop at the calculated range, and optionally for windage and optionally for moving target hold-over.

24 Claims, 10 Drawing Sheets

U.S. PATENT DOCUMENTS

| | | | | |
|---|---|---|---|---|
| 2006/0005449 | A1* | 1/2006 | Smith, III | 42/122 |
| 2006/0010757 | A1* | 1/2006 | Smith, III | 42/122 |
| 2007/0144052 | A1* | 6/2007 | Smith, III | 42/122 |
| 2007/0277421 | A1* | 12/2007 | Perkins et al. | 42/122 |
| 2008/0098640 | A1* | 5/2008 | Sammut et al. | 42/122 |
| 2008/0202011 | A1* | 8/2008 | Shepherd | 42/130 |
| 2009/0183417 | A1* | 7/2009 | Smith, III | 42/122 |
| 2009/0200376 | A1* | 8/2009 | Peters et al. | 235/404 |

OTHER PUBLICATIONS

Leupold, "Ranging System for the Mil Dot Reticle—Operating Instructions", Leupold & Stevens, Inc. Beaverton, OR, retrieved on Jun. 6, 2008 from http://www2.leupold.com/resources/downloads.htm.

Bushnell, "Elite 1500 User's Manual", Bushnell Outdoor Productgs, Lenexa, KS, retrieved on Jun. 6, 2008 from http://www.bushnell.com/customer_service/manuals/rangefinders/20-5101_manual.pdf.

Leupold, "RXB-IV Digital Laser Range Finding Binoculars—Operating Instructions", Leupold & Stevens, Inc. Beaverton, OR, retrieved on Jun. 6, 2008 from http://www2.leupold.com/resources/downloads.htm.

Wikipedia, "Multiple Integrated Laser Engagement System (MILES)", retrieved on Jun. 6, 2008 from http://en.wikipedia.org/wiki/MILES.

Nikon, "Nikon Monarch LASER800 Instruction Manual", Nikon USA, retrieved on Jun. 6, 2008 from http://support.nikontech.com.

Clark, Col. Julius E. (US Army), "Army Joint Support Team", retrieved on Jun. 6, 2008 from sill-www.army.mil/bcd/Conferences/2005AJST%20Overview%20COL%20Clark.ppt via Google.com search for "military team fire coordination training system".

* cited by examiner (a) Circle or other shape shown around aiming dot shows user's bench grouping size projected to range of actual target (b) Alternate shape shown around aiming dot shows user's bench grouping size projected to range of actual target

SYSTEM AND METHOD FOR DETERMINING TARGET RANGE AND COORDINATING TEAM FIRE

CROSS-REFERENCE TO RELATED APPLICATIONS

This application claims benefit of the filing date of provisional patent application 61/029,203, filed on Feb. 15, 2008, by Thomas D. Smith, III.

FEDERALLY SPONSORED RESEARCH AND DEVELOPMENT STATEMENT

This invention was not developed in conjunction with any Federally sponsored contract.

MICROFICHE APPENDIX

Not applicable.

INCORPORATION BY REFERENCE

Issued U.S. Pat. Nos. 7,237,355; 7,222,452; 7,194,838; 7,069,684; 6,591,537; D456,057; and 6,357,158; and U.S. provisional patent application 61/029,203, filed on Feb. 15, 2008, are hereby incorporated by reference in their entireties.

BACKGROUND OF THE INVENTION

1. Technical Field of the Invention

This application relates to displays within scopes used for aiming rifles, pistols, and other projectile delivery systems. It especially relates to determining range-to-target values, providing range and windage-corrected aiming points, up-hill and down-hill, altitude, barometric pressure, barrel temperature and the other various affects commonly grouped as external ballistics and coordinating team firing activities.

2. Background of the Invention

Apparatuses for aiming of guns for sporting, competition, law enforcement, and military purposes are well known and wide spread. A very common aiming devices is known as a "scope", which may be mounted to a variety of guns and weapons, including but not limited to rifles and pistols. Some scopes include a fixed magnification, or a variable magnification (zoom) feature.

However, due to certain forces on projectiles while in flight after the gun or weapon system has shot or launched the projectile, aiming and predicting accurately the point of impact of a projectile is more difficult than just determining a straight "line of sight" from the muzzle of the gun to a target. Projectiles are diverted from straight flight by a number of factors, including but not limited to, wind resistance, cross-wind vectors, and gravity. As such, ballistic paths within the Earth's atmosphere are often modeled simply as pseudo-parabolic vertical paths having a constant horizontal offset vector according to an average or mean cross wind speed.

Beginning shooters do not recognize the problem, but advanced and precision shooters, however, agree that such a simplification is unreliable for humane harvest of sentient animals or critical situations, such as hostage rescue team snipers, and for long range missions, such as military snipers. In these situations, variations in altitude, humidity, barometric pressure, cartridge chemicals, weight of projectile, and shape of projectile have considerable effect. Many competitive long range shooters, for example, "reload" their own shells to ensure uniformity of the chemical and hydration mixtures in each shell and the volume variation by manufacture, and they often resort to many idiocyncratic variations such as polishing their projectiles to ensure uniformity in projectile shape and wind resistance.

To address a very broad range of shooting applications, from small game to large game, short range to long range, from civilian to military, industry has responded by developing approximately 1500 different calibers, bullet shapes, and cartridge designs.

Because a projectile will drop a significant amount during such a long range trajectory, range estimation or measurement remains an important task or skill of the shooter. Further, selection of the proper "load" (e.g. caliber, bullet shape, bullet weight, etc.) is also critical to achieving accurate shot placement. The two factors are interrelated and co-dependent trajectory shape and load characteristics.

To accurately measure range-to-target values in long range applications, many shooters utilize electronic means, such as a laser or radar-based range finder. In certain scenarios, however, use of a range finding device which emits a "scatter" of signal can be dangerous and contraindicated. For example, such scatter can be detected, and the source pinpointed, by many military countermeasures. So, use of a laser range finder in a covert application on a battlefield may result in revealing the location of personnel.

Some range measuring techniques using markings on reticles in scopes have been developed. For example, the widely-used "Mil-Dot" reticle can be used to determine ranges by performing certain calculations relative to the graticule marks in the scope. But, these techniques remain math-intensive, are extremely distracting to the essential psychopsysiological performance state required for a successful shot, and are not conducive to practice by shooters of limited math skills or education. Additionally, some research shows that a human's math skills are diminished during times of intense stress, while other mental skills are increased, such as visual acuity. This shift of available mental faculties may temporarily disable a trained shooter from performing range calculations at the very time he or she may need them most.

In a different, but related problem, training of users of scope-equipped guns remains difficult because a coach is unable to see in real-time what the shooter is seeing. So, the coach is relegated to using diagrams and verbal descriptions to convey to the shooting student what the "sight picture" (e.g. the view of the target through the scope") should look like, including any offsets (e.g. "holds" for bullet drop, windage, etc.).

In a similar application, teams of shooters, such as military sniper teams and hostage rescue teams, often are required to coordinate and assign targets. Coordination and command is usually performed by a centralized authority, but again, the central authority is unable to actually see what the team members can see via their scopes. So, the central authority must rely upon descriptions from the team members to make critical, sometimes life-or-death, decisions based upon these descriptions.

Therefore, there exists a need in the art for a means to provide quick and accurate range determinations when using a scope-equipped gun or weapon without relying upon mathematical or computational skills of the user. Specifically expert shooters understand the essential nature of never taking your eyes off the target once the target is acquired. There further exists a need in the art to share visual information from scopes of members shooting teams and groups to allow for improved training, coordination, and command.

SUMMARY OF THE INVENTION

A system and method for use of an enhanced aiming system which includes a marker displayed at a first position in an aiming scope, a user input of a start position and an ending position to measure a desired impact zone, a calculator for determining a range to the target based on the known dimension of the impact zone and the magnification value of the aiming scope, and a display in the aiming scope for showing an aiming point dot or bar to compensate for projectile drop at the calculated range, and optionally for windage and optionally for moving target hold-over.

BRIEF DESCRIPTION OF THE DRAWINGS

The figures presented herein when taken in conjunction with the disclosure form a complete description of the invention.

DETAILED DESCRIPTION OF THE INVENTION

For the reader's conveniences, issued U.S. Pat. Nos. 7,237,355; 7,222,452; 7,194,838; 7,069,684; 6,591,537; D456,057; and 6,357,158 provide a great deal of background information regarding riflescopes and use of my other riflescope inventions. The present invention is preferably realized in conjunction with my previous riflescope inventions, but may be realized separately, as well.

Figure 1A:
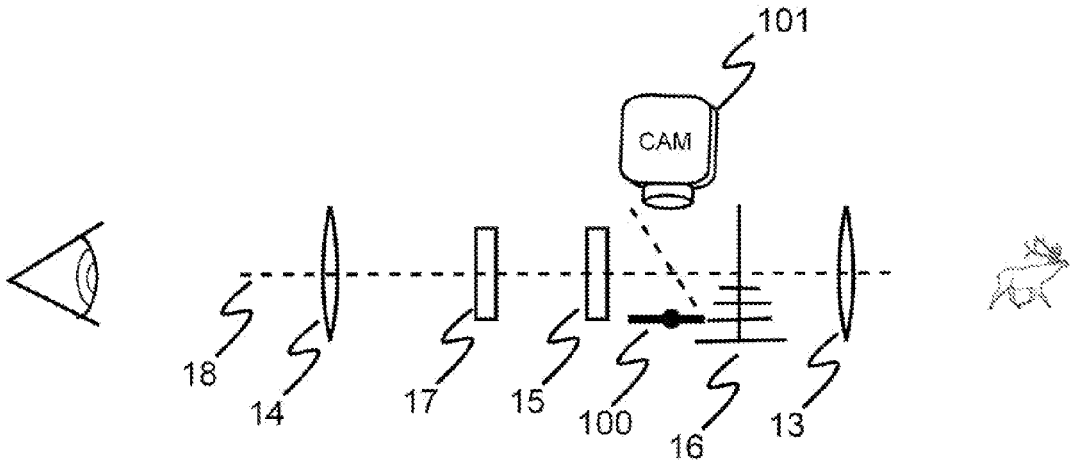
FIGS. 1*a* and 1*b* are schematic illustrations of the internal components of a variable power telescopic sight for a gun.
Figure 1B:
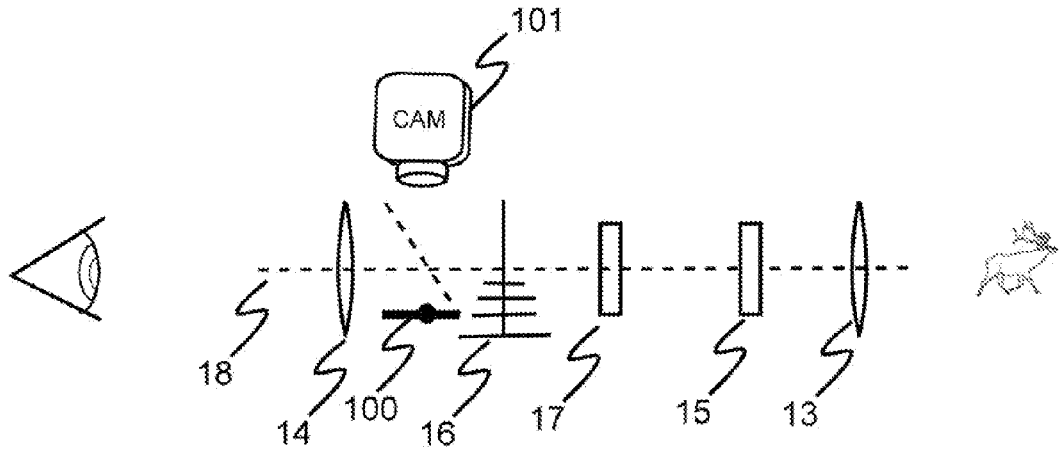
Figure 1C:
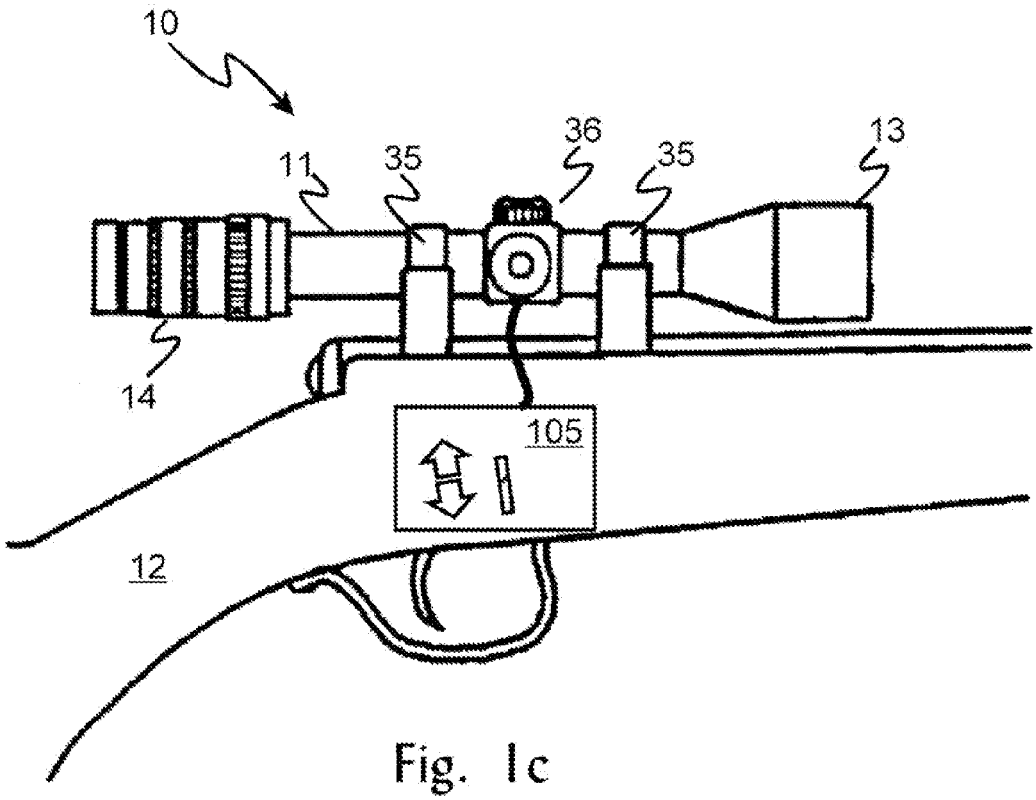
FIG. 1*c* is a side elevation view of a telescopic sight embodying the invention mounted upon a gun of the type commonly used for hunting, target shooting and related practices.

Turning to FIGS. 1*a*-1*c*, a telescopic sight 10, embodying this invention is shown attached by a suitable mount 35 to a gun 12. The sight 10 is formed by a tubular housing 11 containing a forwardly positioned objective lens element 13, a rearwardly positioned ocular or eyepiece lens element 14, an intervening erector lens element 15, and a reticle 16 disposed between the objective lens element 13 and the erector lens element 15. In the case of vari-focal or zoom scopes, a positionally adjustable magnifying lens 17 is associated with the erector lens element 15. The exterior of the housing 11 may be equipped with rotationally moveable features 36 for adjusting focus, parallax, magnification ratio, windage and elevation. Each of the various lens elements may be single lenses or combinations of lenses, either aligned in proximity or glued together or a combination of these compositions.

The reticle 16 is a circular, planar or flat transparent panel or disk mounted within the housing 11 in perpendicular relationship to the optical axis or line-of-sight 18 through the scope, and is positioned between the objective lens element 13 and the erector lens element 15, typically at a site considered to be a front focal plane of the optical system within the housing. The reticle 16 contains fine etched lines or hairline indicia comprising a center vertical hairline 19 and a center horizontal hairline 20, which orthogonally or perpendicularly intersect at a center point 26. The reticle further defines first, second, third and fourth horizontal range and aiming marker hairlines 21, 22, 23 and 24 (or other designs as may be appropriate to specific applications) respectively intersecting the vertical hairline below the center point 26 and vertically spaced apart and of preferably sequentially increasing length. Each such range and aiming marker hairline 21, 22, 23, and 24 is bisected by the center vertical hairline 19, in the present design in a horizontal manner but potentially in an angled manner as necessary to account to the vertical component of wind drift, etc.).

We must also note that it is feasible to present a virtual reticle into the sighting system by other means, chiefly electronically, and that the absence of a physical reticle in no way alters the functionality of the present invention; therefore, any means of generating aiming points that achieves the same goal as that described herein is fundamentally identical in nature and is also claimed.

It should also be noted, that although a preferred embodiment of the invention utilizes a set of subtending range marker bars below the main crosshair intersection corresponding to bullet drops at given ranges, other reticles, such as but not limited to a MIL-DOT reticle, can be used with the present invention.

Integrated Display

Figure 2:
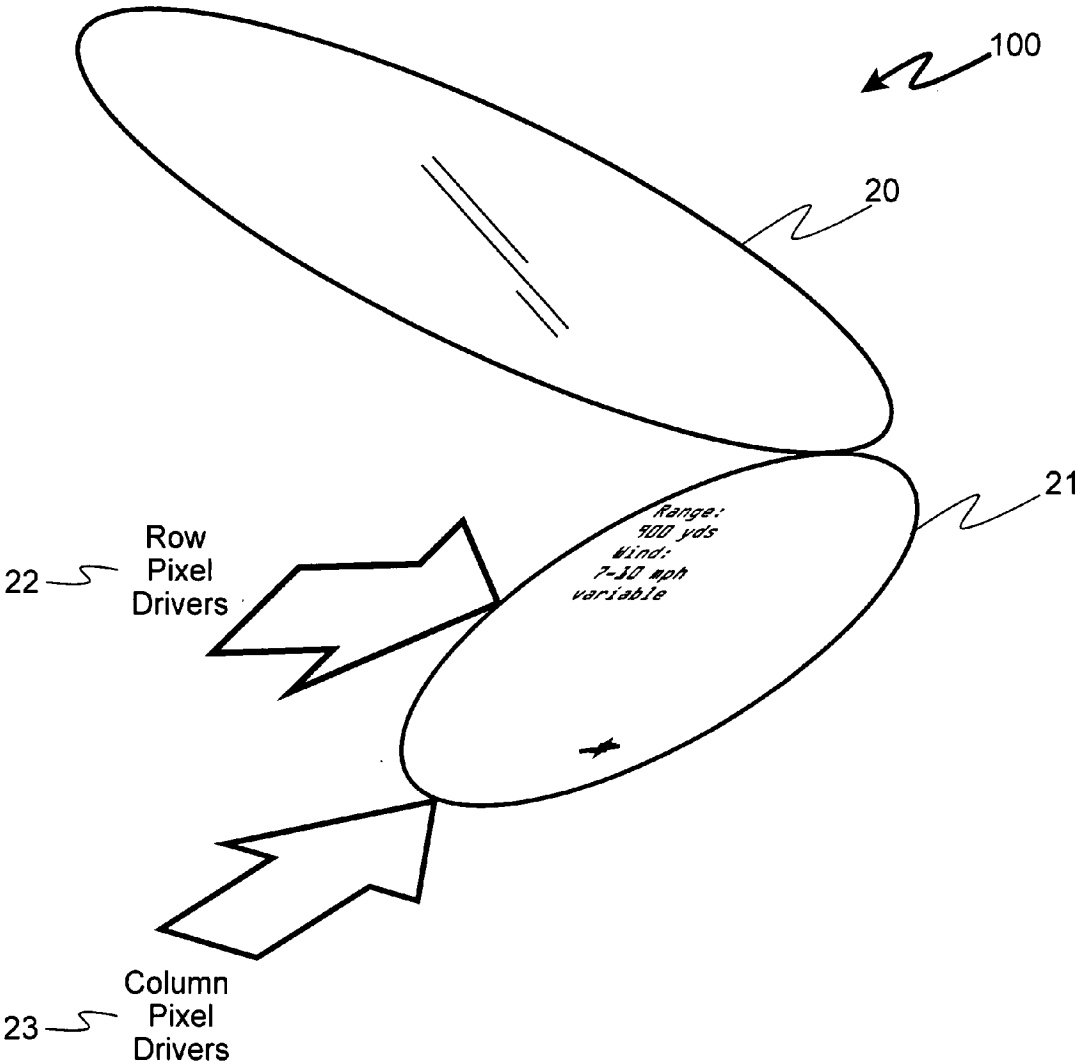
FIG. 2 illustrates one available embodiment of a head-up display type of subassembly for optically overlaying the invention's aiming point and text onto the image of a reticle and target in a scope.

FIGS. 1*a* and 1*b* illustrate schematically the integration of a display unit 100 in the optical chain, and optionally a camera 101. In one embodiment, the display unit 100 comprises a dot matrix light emitting diode (LED), plasma, or liquid crystal (LCD) or other suitable electronic display mounted substantially parallel with the optical axis or line-of-sight 18 of the assembly, and a partially reflective (diagonal dotted line) lens is positioned at an angle such as a 45 degree angle to the optical axis, so as to allow the image of the target to pass through to the eyepiece, while also transparently superimposing a reflection of the display onto the target. Such a display sub-assembly is shown in more detail in FIG. 2, in which the display panel 21 is positioned at an angle to the partially reflective lense (20), and is provided with row and column pixel driver signals in order to produce graphic images (dots, lines, etc.) and text. This embodiment option resembles a miniaturized heads-up display (HUD), such as the larger units provided in aircraft and automobiles. In some arrangements, the display may be displayed upside down and/or mirror reversed in order to compensate for similar rotations and flips in the image of the target due to optical characteristics of a given scope design.

Figure 3:
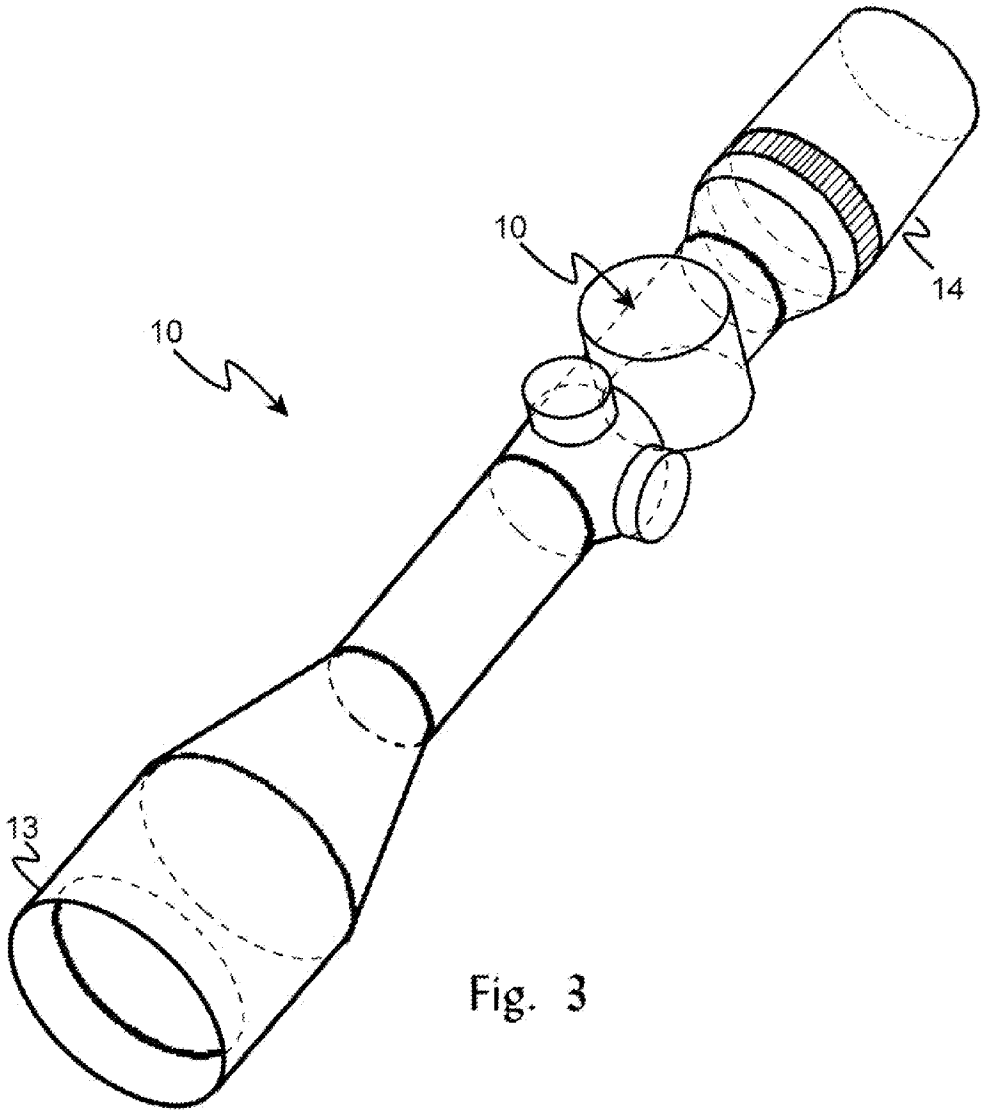
FIG. 3 depicts one possible scope housing with an additional portion for receiving the display unit.

FIG. 3 shows a perspective view of a scope body improved to house (30) the display unit 100 in a portion of it. In actual practice, the sub-housing portion which receives the display unit can be of any suitable shape, but is shown as a cylindrical portion to match the illustration of the circular display example of FIG. 2.

In an alternate embodiment, the display may be a partially transparent disc, such as an LCD disc, which is fitted into the optical chain substantially perpendicular to the optical axis. This embodiment allows the shape of a traditional scope housing to remain unchanged, but may have optical disadvantages depending on the optical transmission characteristics of the disc.

Display Control Unit

A display control unit 105 is illustrated as being mounted to the side, or within the stock of, the gun 12 to which the scope 10 is mounted, as shown in FIG. 1*c*. In alternative embodiments, this control unit may be integrated into the scope itself, or mounted at other locations, such as the handguard, forestock, or buttstock.

Figure 1D:
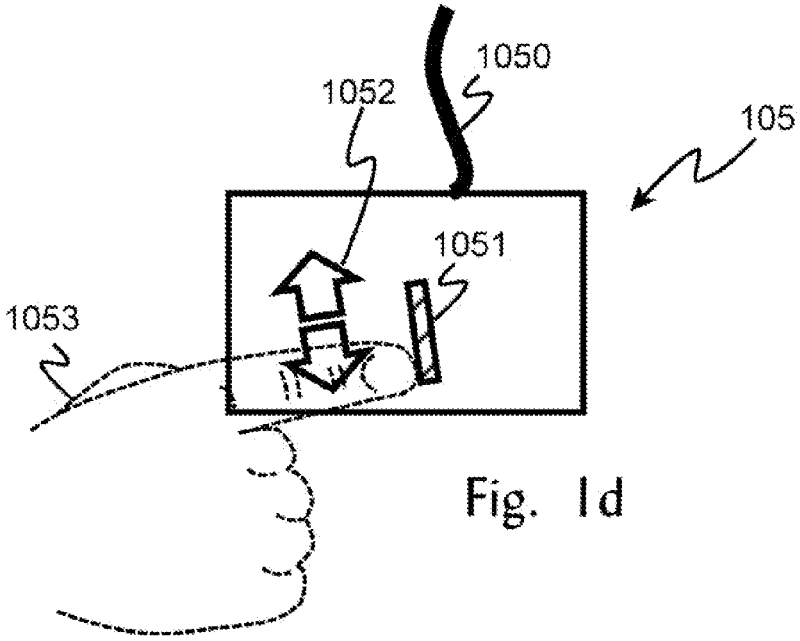
FIG. 1*d* provides an illustration of an example control panel for a clickable scroll wheel.

FIG. 1*d* provides more details of the control unit 105, which houses the control logic and/or microprocessor, and provides one or more user-operable input means, such as a scroll-and-click wheel 1051, set of buttons (up, down, next, previous, enter, etc.) 1052, or both. In the position shown on the rifle of FIG. 1*c*, a user's trigger finger can easily and safely reach the inputs 1051 and 1052 without repositioning the hand 1053 on the rifle grip, and without accidental trigger operation.

A wire or cable interconnect 1050 provides electrical signals to and from the scope to drive the pixels of the display, read the position of the zoom ring, and optional drive a servo motor to set the position of the zoom ring.

Figure 4:
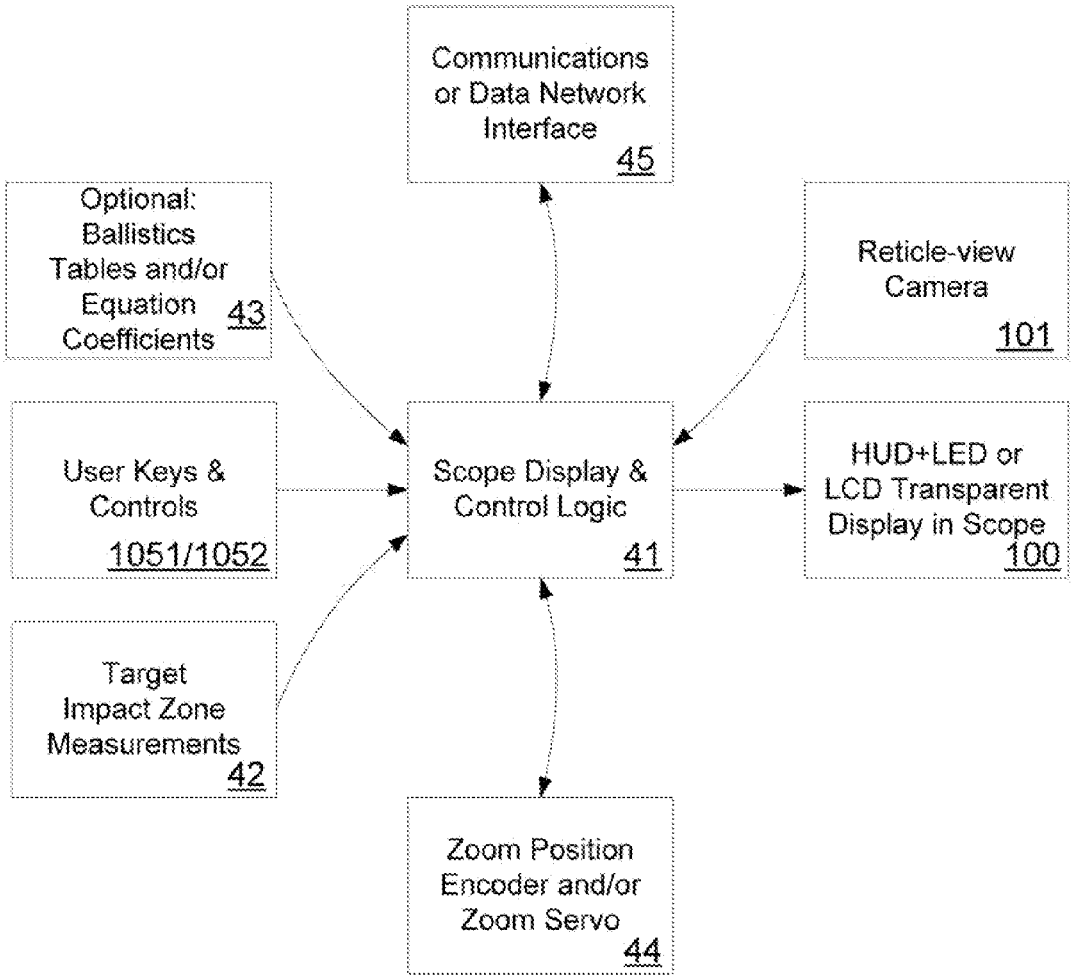
FIG. 4 provides a functional block diagram of the invention.

FIG. 4 shows a block diagram of the functions of the control unit, the display unit, and an optional camera 101. Logical circuitry, a programmed microprocessor, or a combination of circuitry, processor and programs 41 are provided with a set of target impact zone (IZ) measurements 42. For example, the (IZ) measurements may be sorted and categorized by type of target (e.g. white tail deer, black bear), and by zone within each target type (e.g. head, chest, etc.). For example, a target zone height for a whitetail deer's chest might be 18", and width of the chest zone may be 15". The IZ measurements (42) can hold dimensions for a few target types and zones, or it can hold many dimensions for many target types and zones.

The user input keys and scroll wheel 1051 and 1052, and a zoom ring position encoder are read by the logic 41, and their positions used in the logical processes to illuminate dots, bars, and text on the display (100).

Optional enhanced embodiments include storage of one or more ballistics tables or equations (43), as well as a communications or data network interface, such as a Wireless Fidelity (WiFi) or military wireless JDAM interface.

More details of the operations and logical features of the control unit will be set forth in the following paragraphs.

Method of Use for Range Finding

Figure 5:
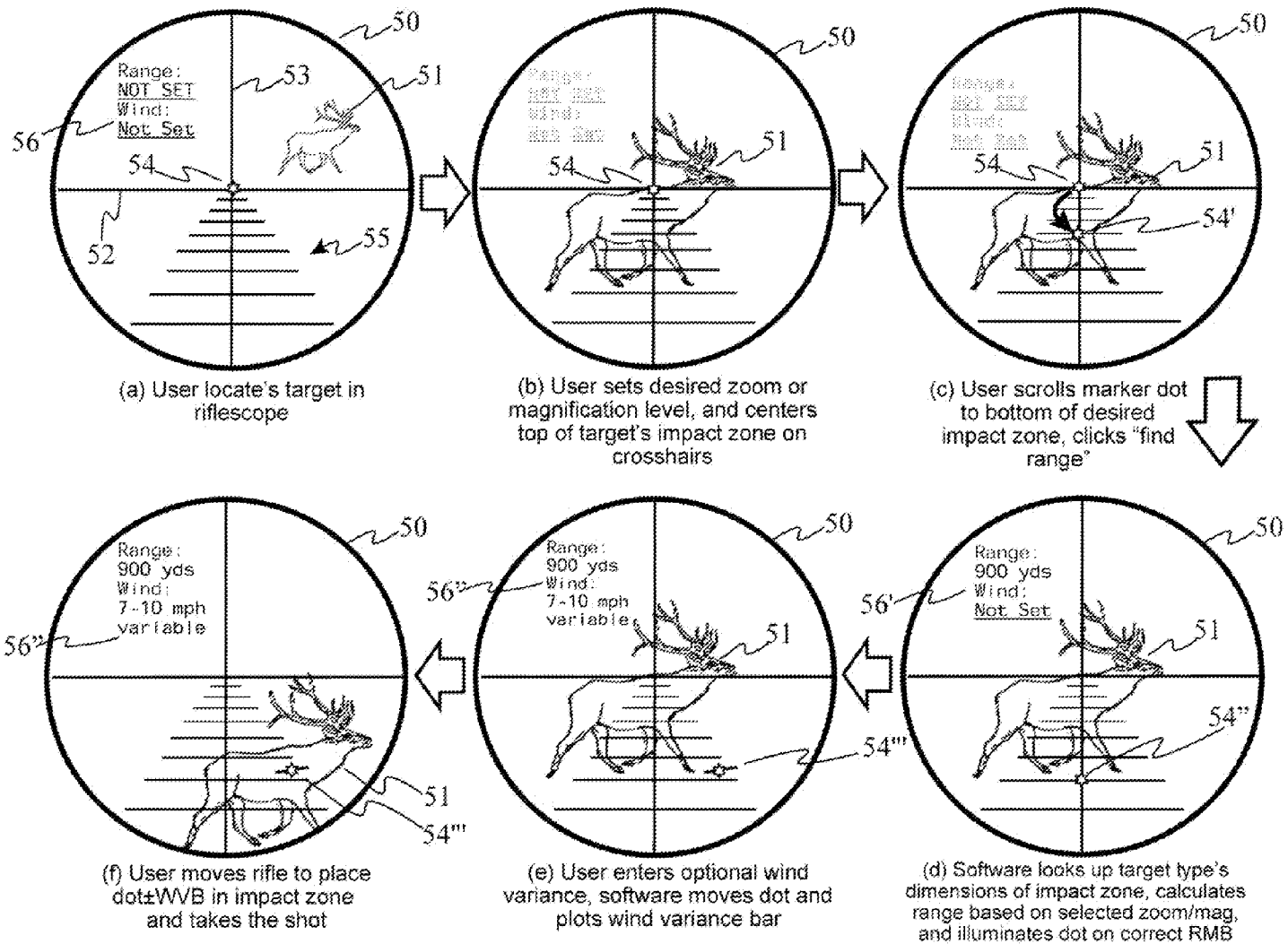
FIG. 5 provides example illustrations of usage of the invention in a riflescope to hunt an animal.

Turning to FIG. 5*a*, it will be useful to the reader to understand the basic method of use and user interface prior to describing the logical processes of the invention. In this figure, a perspective of a user/shooter looking through the scope (50) according to the invention is shown in a step-by-step manner.

First, in step (a), the user positions the rifle, pistol, or gun such that the target (51) is viewable somewhere in the scope (50). In this idle mode, the reflected display shows (56) that the range to the target is not yet set, nor is the wind correction value set yet. And, an illuminated dot (54), such as a red dot, is positioned anywhere in the reticle, preferably on the main crosshairs (52,53) or on a subtending range marker bar (55).

In the next step (b), the user manually sets the desired magnification level using the zoom ring on the scope. This illustration shows that the user has increased magnification such that the target appears (510 larger in the reticle. Further, the user positions the rifle and scope such that the current dot position (54) lies on a first edge of the desired impact zone of the target, such as the top or left edge of the impact zone. In this example, the user has positioned the rifle such that the dot and main crosshairs are positioned at the top of the shoulder of the animal to be taken.

In the next step (c), the user operates the user inputs (1051) and (1052), such as depressing and clicking a scroll wheel, then releasing the scroll wheel, followed by rotating the scroll wheel to move the dot to the opposite edge (54') of the desired impact zone. In this example, the user has scrolled down to the bottom of the IZ. If the user desires, the measurement can be made left to right, right to left, or bottom to top, instead of top to bottom, as well.

When the dot is located at the opposite edge of the impact zone, the user terminates the input by clicking again, pressing an enter key, or similar user input. The control logic then (d) looks up the dimensions of the target's impact zone (42), reads the current zoom setting from the encoder, and calculates the range to the target. Such a calculation, given the information from these components of the invention, can be accomplished in several manners, all of which are within the skill of the art to implement in programming or logic.

Next, the control logic illuminates an aiming point dot in the display such that it will correspond to the proper position or range marker bar (54") on the reticle to compensate for bullet drop at the calculated and displayed range. And, preferably, the text display is updated (56') to show the calculated range.

At this point, the user can raise or lower the rifle to place the aiming point dot in the impact zone, adjust manually for windage, and take the shot.

However, according to a preferred embodiment of the invention, the user may also proceed to the next step (e) in which the user enters or adjusts a wind value, such as a single value or range of values. In this example, the user has input a wind range of 7 to 10 m.p.h. from the right. Again, scrolling and/or key inputs may be used to select or adjust these values.

Once the wind values are input, the control logic then calculates the amount of horizontal drift or offset, and moves the aiming point accordingly to compensate for windage (54'''), and preferably updates the text display to show the wind value (56").

Finally, the user moves the rifle (or other gun) to position the aiming point dot within the impact zone of the target (51), and takes the shot.

In alternate methods of use, the user can input the wind values in advance of acquiring a target, such that fully compensated aiming points can be realized within 1-2 seconds to complete steps (a)-(e).

This manner of usage of the invention allows very quick and accurate range estimates and hold point (e.g. aiming point) determinations without the need for complex mental mathematics, without the need for removing the hands from the normal shooting positions on the rifle, and without taking the users eyesight off of the target. In sum, these advantages allow for quick and accurate placement of shots at very long ranges.

Windage Range Variance Bar

According to an optional aspect of the present invention, when the user supplies a range of wind values, such as right 7 varying to 10 mph, a bar is show in the reticle display extending from the minimum wind hold point to the maximum wind hold point, as shown in FIG. 5*a*, steps (e) and (f).

Multiple Impact Zones Per Target Type

According to an optional aspect of the present invention, the stored impact zone measurements (42) include multiple impact zones per target type. For example, an alternative impact zone for a head shot for the same target type shown in FIG. 5 can be entered, and the user has selected a target type of white tail deer. By entering head instead of chest as the impact zone for the white tail deer, the control logic looks up a second impact zone dimension to calculate the range. Otherwise, the steps remain the same as those described in conjunction with FIG. 5, except substituting the head zone for the chest zone dimension.

Display Colors for Mental Cues

According to an optional aspect of the present invention, a color display is utilized to convey an extra level of information to the user in a quick-to-comprehend format. For example, the dots in steps (a) through (c) of FIG. 5 may be shown as red dots to indicate the aiming point is not adjusted for range or windage. Then, when the aiming point dot has been adjusted for range, but not for windage, the aiming point dot may be shown in yellow (step d), at which point the shooter may manually adjust for windage and take a shot.

Finally, as windage is factored into the aiming point adjustment, the aiming point dot may be shown as green to indicate the aiming point is fully compensated.

In other embodiments, flashing and steady states of the dot may be utilized to convey similar status information.

Similarly, the text may be shown in colors, such as red for text indicating in input parameter has not been entered or calculated, and green for text indicating a parameter which has been input or calculated.

Incremental and Accelerating Scrolling Action

To ease and speed the completion of the impact zone dimensions input from the user, the control logic may accelerate the rate of movement of the dot after an initial scrolling rate, or it may advance or jump the dot by increments to allow course positioning of the dot first followed by fine positioning last.

Circular Markers for Impact Zone in Range Finding

In an optional embodiment, instead of scrolling and moving a dot to mark the edges of an impact zone, circles, squares, or other shapes can be shown to allow the user to quickly encompass or encircle the impact zone.

Automatic Zoom Setting for TDS Trifactor Calibration of Reticle to Load

According to an optional aspect of the present invention, a TDS Trifactor Reticle™ such as those described in my U.S. Pat. Nos. 7,237,355; 7,222,452; 7,194,838; 7,069,684; 6,591,537; D456,057; and 6,357,158 is provided in the scope. In such a case, or even with other reticles, a servo motor under the control 44 of the control logic may be provided to automatically position the zoom ring on the scope, as illustrated in FIG. 4.

In particular with the TDS Trifactor Reticle™, the "factor" of the particular load can be used to automatically select a zoom level by the servo motor which will scale the subtending range marker bars to the exact ballistics of the load being used.

With other reticles, the optional ballistics tables or equations 43 may be used to select a zoom level in order to scale part or all of the reticle's markings appropriately to the ballistics of the actual load being shot.

Alternatively, an embodiment is available in which the logic 41 determines an appropriate zoom level, and displays that zoom level (e.g. 12×, 9.5×, etc.) in the display 100, allowing the user to manually adjust the zoom ring if desired.

Logical Processes

The logical processes of the invention may be implemented as software, firmware, custom circuitry, or a combination of software, firmware and circuitry. It is within the skill of those in the art to adapt the following logical process descriptions with suitable design methodologies. For these reasons, the operations as illustrated by FIGS. 6*a* and 6*b* provide at least one example embodiment of the invention which may be reduced be realized.

Figure 6A:
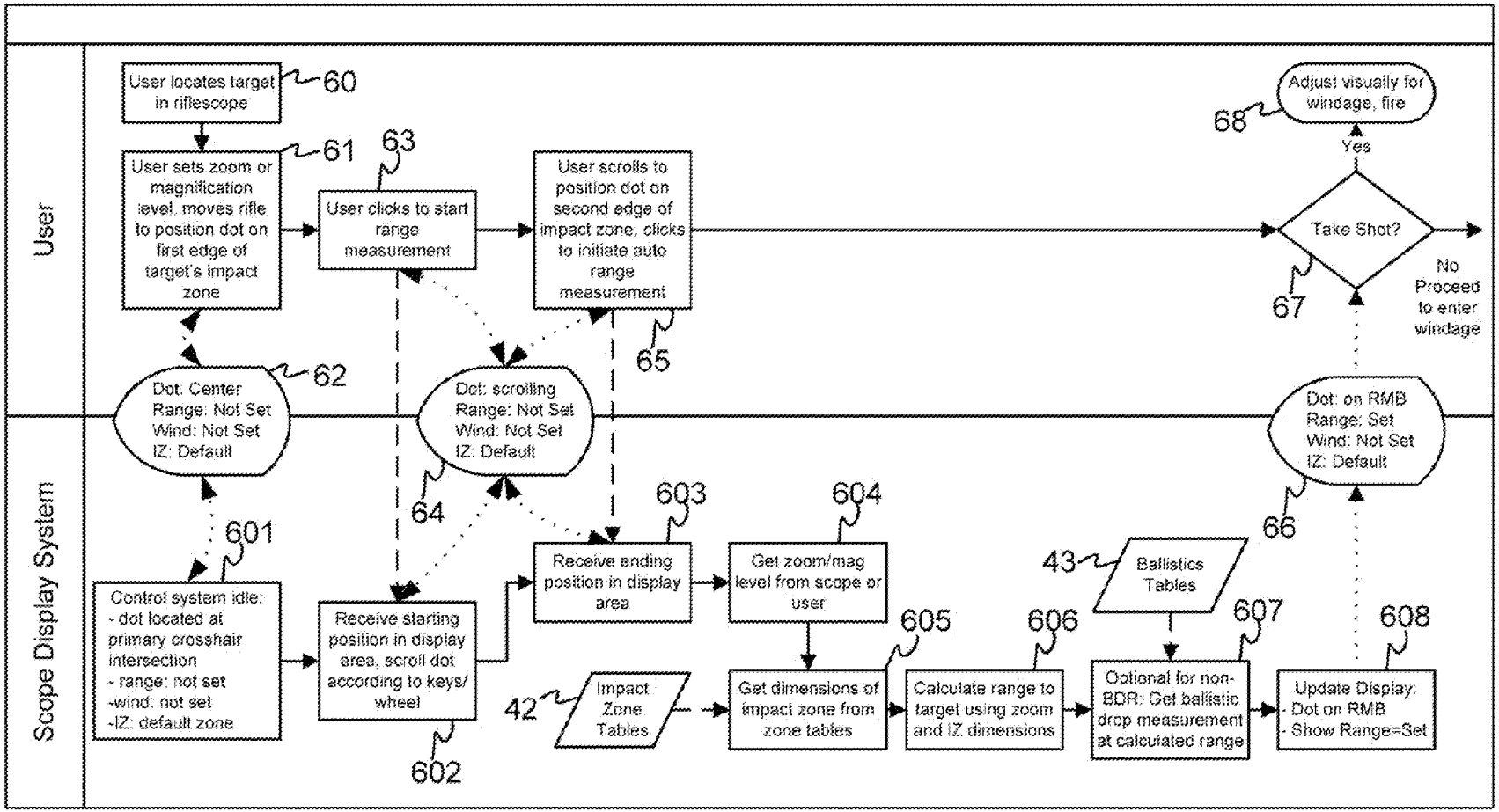
FIGS. 6*a* and 6*b* show logical processes and methods of use according to the present invention.
Figure 6B:
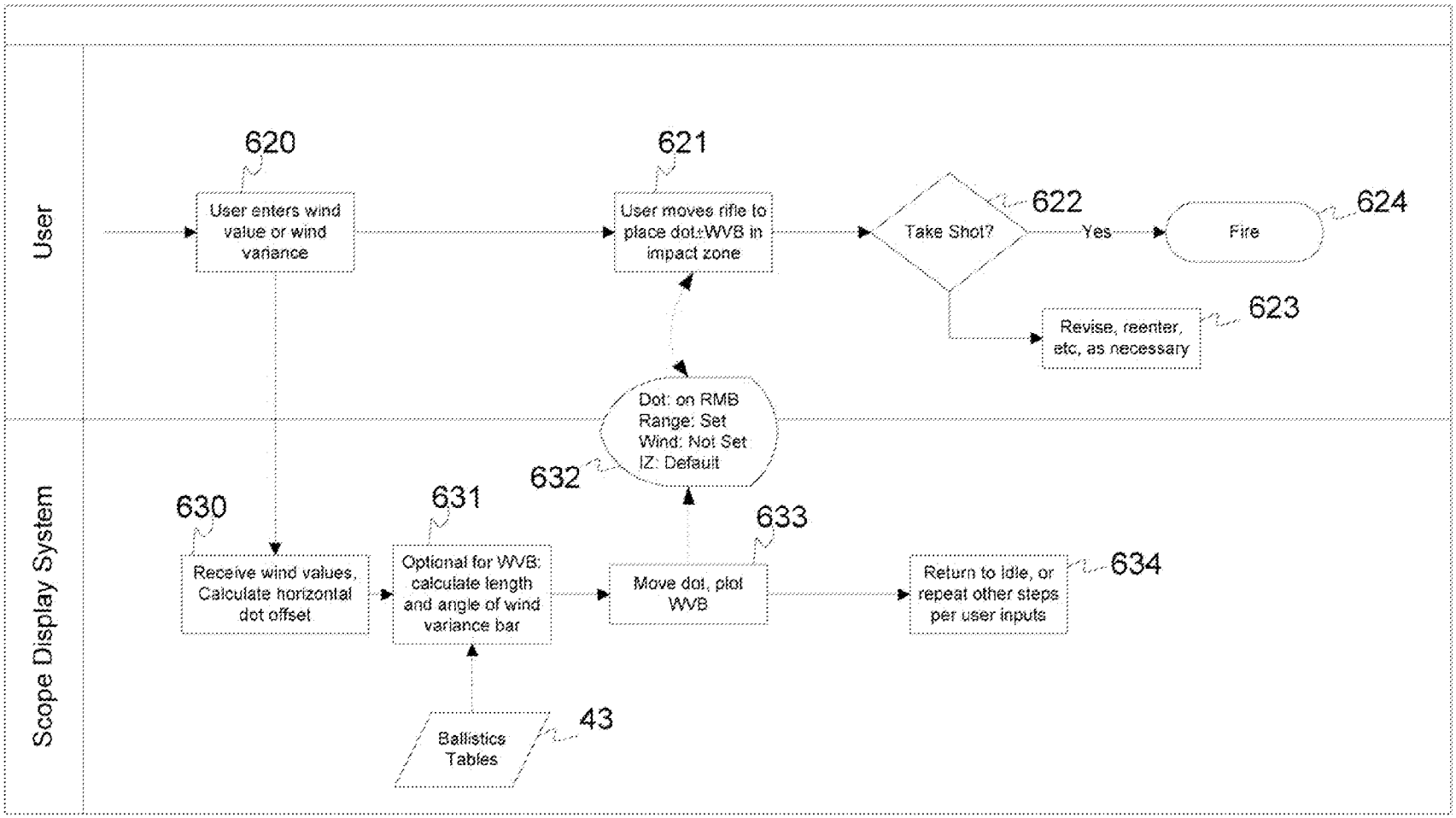

Turning to FIG. 6*a*, and following a similar example as that shown in FIG. 5*a*, the user initially locates the target in the scope 60, optionally sets a zoom level 61, and places the dot (at its default location) on the first edge of the desired impact zone 61. The first edge can be a top, bottom, left side, or right side of the impact zone. The default dot location can be the center of the crosshairs or another point in the reticle. At this idle stage of the logic 601, the display 1000 shows no setting for the range or the windage, and optionally may be showing a selected breed/species and/or impact zone 62.

Next, the user clicks, presses a key, makes a partial draw on the computer, or operates another suitable control 63 in order to initiate the automatic range determining process of the logic. Responsive to receiving this control input, the logic monitors the scroll wheel position, movement keys, or other movement controls, and updates 602 the display 64 to show the scrolled or moved position of the dot in the reticle, until the user has positioned the dot on an opposite edge of the impact zone. At this point, the user terminates the marking of the impact zone by clicking, pressing a key, or operating some other suitable control 65, which is received 603 by the control logic.

The logic then uses the magnification level 604, the impact zone tables 605, and calculates the range to the target by the apparent size in the reticle as marked by the user 606. Next, an estimation of the vertical drop of the selected bullet and load type is retrieved 607 from ballistics tables 43, or calculated from ballistics equations using conventional ballistics estimation means.

Now, the display 100 is updated 66 by the logic 608 to show the dot at an aiming point in the reticle which compensates for bullet drop at the determined range, and the display is updated to show the range value estimation.

At this point, the user can decide 67 to take an early shot by manually adjusting the aiming point to the left or right of the aiming point dot to compensate for windage, and the shot can be taken 68.

However, if the shooter wishes, he may continue to refine the aiming point by inputting 620 wind value (e.g. 8 mph from the right) or range of wind values (e.g. variable 7 to 10 mph from the right), as shown in FIG. 6*b*. The logic receives this input 630, and calculates a horizontal windage offset to correct the aiming point display for windage. Optionally, if the user has input a range of wind values, a Wind Variance Bar (WVB) is calculated 631 to stretch in the display from the minimum wind value to the maximum wind value, which effectively indicates to the shooter the likely area of bullet impact at the determined range in the wind conditions provided by the user. The aiming point dot, and optionally the WVB, are positioned on the display appropriately 632.

The user can now move 621 the gun to place the dot and/or the WVB in the impact zone of the target, and the optionally take the shot 622/624.

Alternatively, if the target has moved, conditions have changed, etc., the user can return to any previous state in the process 623/634 to revise conditions, and to get corrections to the aiming point provided in the reticle.

Hold-over Estimation and Compensation

In a similar manner as described relative to the windage adjustment, the aiming point can be compensated for a moving target based on user input for the direction and rate of movement. For example, the user may input a rate of movement of 3 mph to the left. This would be added to the windage value if the wind and movement are in the same direction, and subtracted from the windage value if the wind and movement are in opposite direction. Then, when the aiming point and/or WVB are plotted on the display, the aiming point will include the proper amount of hold-over to allow the user to place the aiming point dot on the desired impact zone and take the shot, rather than to have to place the aiming point ahead of the moving target to compensate for movement.

Reticle-view Camera

As shown in FIGS. 1*a* and 1*b*, in at least one embodiment of the invention, an electronic camera is provided in the scope assembly to allow a view of the display, reticle, and target, from the same perspective as the shooter/user. In the example embodiments of these figures, the same partially reflective screen (20 of FIG. 2) is utilized to provide a composite image to a camera 101. The camera image data is then transmitted to a remote display via a communications or data network (45 of FIG. 4) for additional use, as described in the following paragraphs.

Team Operation Via Camera and Remote Display Manipulation

Figure 7:
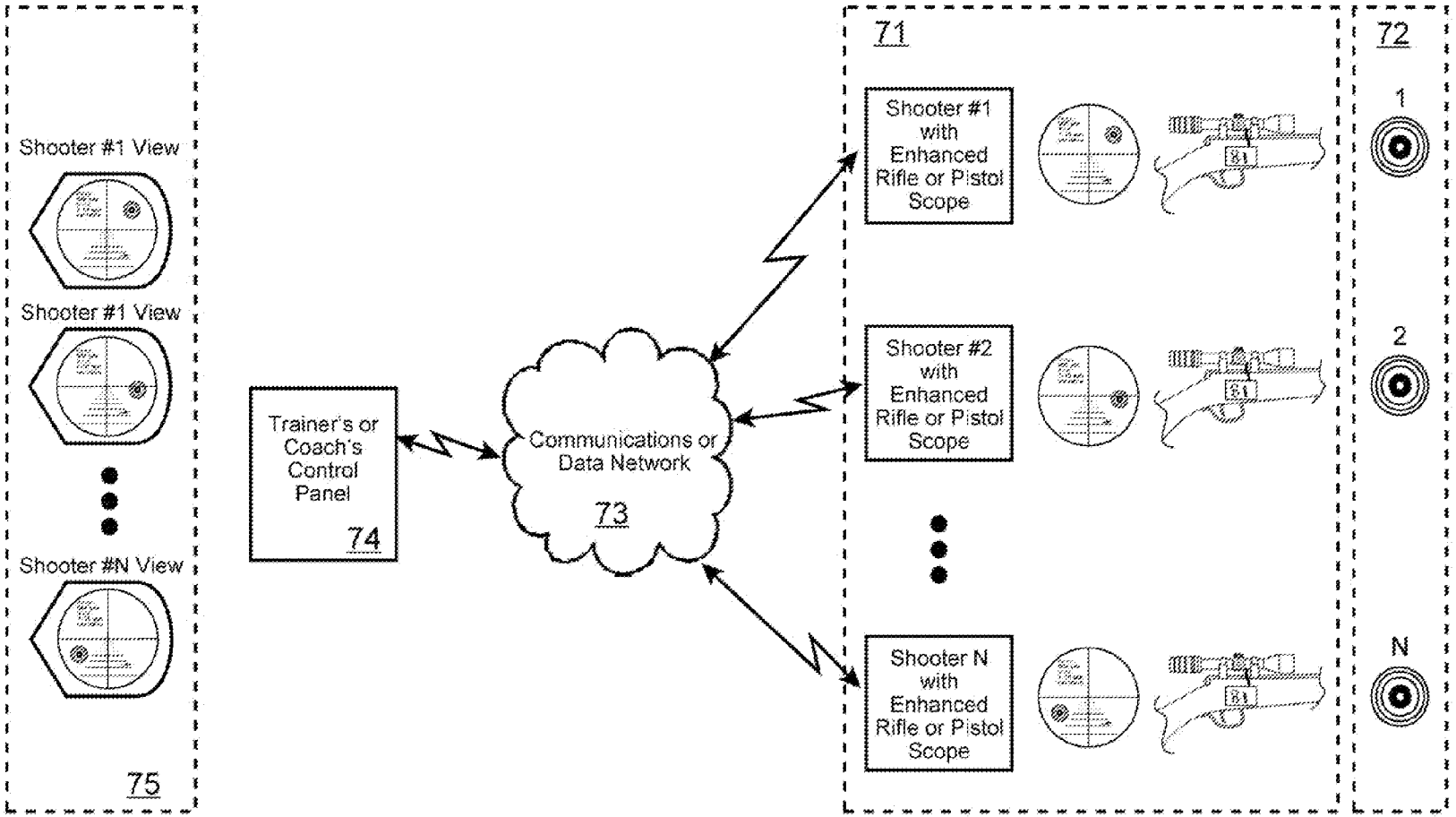
FIG. 7 illustrates coordinated elements for team usage of the invention in several enhanced embodiments.

The camera 101 and network interface 45 allow for an additional level of enhanced operation and usage. A general arranged as shown in FIG. 7 allow a coach or commander 74 to view the reticle images of a plurality of shooters 71 over a network 73. Each shooter's reticle camera image is shown on one or more coach's or commander's consoles 75, and enhanced logical processes of the invention enable a group-level of coordination, training, and cooperation not before available in individual riflescopes.

Training and Coaching. In a training or coaching scenario, the coach 74 can see how each shooter 71 has aligned his or her reticle on his or her respective target 72. By being able to actually see the reticle alignment, the coach or trainer can then provide instructions on adjustments and repositioning, such as by verbal instructions (e.g. by radio or in person).

Additionally, with enhancements to the logical processes of the present invention, the coach's console is provided with a pointing means, such as a mouse or joystick, for which control data is transferred from the console to the rifle's display control logic via the network. This coach's mouse or joystick then controls an additional dot or pointer in the display of the scope of each shooter, which allows the coach to visually show the shooter which target to use, which range marker bar to use, and where to position the reticle relative to the target. Each shooter is preferably provided with his or her own coach's dot so that the coach may provide individualized instruction to each shooter.

Fire Coordination. In the usage scenario of a multi-shooter fire team, the commander of the team operates the coach's console 75 and uses the coach's dots to assist in assigning targets to each shooter, communicating changes in reticle placement, etc.

Snapshots for Remote Review and Approval. In a further enhanced manner of usage and logical processes, the shooter is provided with a control means to take a "snapshot" of his or her reticle view, such as by double clicking the scroll wheel. This snapshot of the user's reticle view can include a image of a target of question.

When the image is received by the commander or coach, the commander or coach review the image and approve or disapprove taking the shot. For example, in a coaching scenario, the user may take a snapshot of an animal he or she believes is a legal animal (age, species, gender, etc.) to take. If the coach agrees, the coach can so indicate by positioning or moving the coach's dot in the shooter's reticle.

Biometric Classification of Target. In yet a further enhanced manner of usage and logical processes, the snapshot of the reticle image is received by a biometric recognition and/or classification process, such as a facial recognition system. The biometric recognition and/or classification process may be onboard the gun, such as being integrated into the display control logic, or may be remote to the gun interconnected via the network. The results of the recognition and/or classification process may be provided in the reticle by transmitting the results via the network to the control logic, and updating the display appropriately.

Side-by-Side Image Display. In yet a further enhanced manner of usage and logical processes, an image is downloaded to the display via the network, and is displayed coincidentally in the reticle with the real life view of the target. Such a downloaded image can be used to make a side-by-side comparison by the user of the currently viewed target with a previously-taken image or photo of a target similar to that which the shooter is instructed or desiring to take. For example, during doe season, a new shooter may be provided an image of a deer doe for reference in the reticle, which can be compared in real time to the actual animal being viewed through the scope. In a military or law enforcement application, and image of a sought enemy or fugitive can be displayed in the reticle for real-time comparison by a sniper to face of a person being viewed through the scope.

Kill Zone Indication

Based upon my experience in harvesting over 200 tons of wild game of all sizes and types, I have determined experimentally that even though a bullet may remain accurate (e.g. predictable path) at long distances, it may or may not still possess the capability of killing or "taking" the targeted animal at those distances. It is generally considered unsportsmanlike and inhumane to wound, but not kill quickly, an animal. Such a wounded animal may flee to a location, and may suffer. Or, in the case of some animals that "hunt back", such as big cats or bears, a wounded animal may pose a safety threat to the hunter.

In military and law enforcement shooting, a similar need arises to make a kill when taking a long range shot. In military operations, it is generally considered undesirable to merely wound or maim an enemy soldier. Doing so may allow the wounded enemy to continue to fight, or to lay in wait "playing dead" until friendly forces approach to detonate explosives. In law enforcement shooting, such as in hostage situations, it is desirable to remove the hostage taker from the scenario in a manner which does not allow him or her to take further harmful action. Wounding, but not killing, a hostage taker with the first shot may result in the death or injury of the hostages, or further danger to law enforcement officials, such as members of a tactical entry team.

However, present day rifle scopes provide no guidance whether a particular round at a particular distance will kill or wound the target. While many of the precision scopes will provide aiming capabilities to deliver the round on the target, it is unknown to the shooter whether or not the round at that distance will possess characteristics sufficient to provide a rapid death of the target.

I have experimented for many years with this concept, and have developed a new science regarding determination of the ability of a round to kill the target. Such information is not contained in ballistics tables, only bullet ballistics coefficient, velocities at certain ranges, energy at certain ranges, drop at certain ranges, etc., are contained in ballistics tables.

I have discovered that there are three important factors about a round in flight regarding its ability to kill or just wound a target. First, the type of target must be considered. A large animal, such as a bear or elk, requires much more "killing power" than a smaller animal, such as a small dear or fox. Conventional thinking is to use larger caliber, larger charges to kill larger animals.

This conventional thinking works for the low end of the scale, but only to a certain degree. For example, a .223 caliber rifle shooting a 165 grain bullet is sufficient to kill a coyote, but would not be a wise choice for hunting bear. But, the same .223 rifle, while accurate at say 600 yards, may not provide sufficient killing power for even a coyote. So, if one were hunting larger game, one might move up to much more powerful charges, larger caliber bullets, and heavier bullets. But even these more power loads are not effect for killing game beyond certain ranges, even though the round itself is still "accurate" (e.g. its position can be accurately predicted with a scope).

So, my second factor that I have discovered is necessary to provide "killing power" for a given prey or game type is the energy possessed by the round at the distance or range to the target. If a bullet does not possess enough kinetic energy at a given distance, it will not cause enough trauma or injury to the game, and it will not kill the animal.

But, energy is not the only factor, I have discovered. For example, a large caliber, heavy bullet will possess a good deal of energy even at lower velocities because energy is a function of mass (e.g. $E=mc^2$, where E is energy, m is mass, and c is the constant speed of light). So, with this well-known relationship, even a locomotive engine moving at just 3 m.p.h. possesses a great deal of energy, but if it bumps into a bear on the tracks, it will not kill the bear, but instead will cause the bear to simply move away (perhaps with a bruise). The same is true for large caliber, heavy bullets at long ranges where the energy is still considerable, but the velocity is lower.

So, to discover the remaining characteristics of what it takes to produce a kill with a single, accurately delivered round, I have applied the theory of energy maneuverability to the consideration of the bullet in flight. Energy maneuverability is a complex theory which explains how objects in flight obtain energy and velocity, maintain energy and/or velocity, and lose energy and velocity. In short, energy maneuverability can be described as a theory which covers "how fast it starts, and how fast it stops". While energy maneuverability is a well-known theory, originated by Col. John Boyd, among modern fighter pilots, it is not known within hunting, precision shooting, sniper, and competitive shooting experts. It has, until my present discovery, remained purely a concept among aeronautical engineers, pilots, and combat aviation instructors.

In applying energy maneuverability to the problem of determining whether or not a bullet will "take" or kill a particular target type, I have discovered that besides target type, predictable bullet position (e.g. known drop), and sufficient energy at a given range, a critical factor is velocity. If a large round impacts a large animal at a range where the velocity is sufficient to provide penetration to the main body cavity, then a kill is likely. If, however, a large round with lots of energy impacts large prey at slower velocities, the round may not penetrate the portion of the animal's body, and may cause only superficial or non-lethal trauma, such as light bruising to broken or shattered bones, to shallow tissue and organ trauma.

But, I have discovered experimentally that it is not a simple matter of setting a minimum velocity and a minimum energy to determine a probably kill with a certain round. I have discovered that the two factors have a "trade-off" relationship, and that for some combinations, there may be an upper-limit to this combination of velocity and energy. For example, smaller rounds at higher velocities may penetrate completely through a certain target, leaving a clean hole through a tissue such as a muscle or fatty area, and not killing the target animal. But, with different shot placement, or on a different animal, such a "clean through" shot may not occur, resulting in all of the bullet's impact being absorbed by the target, and resulting in greater trauma, leading to death of the target.

My conclusion, based on my analysis of thousands of entries in ballistics tables and real-world experience shooting many game types with many loads and bullets, is that a generally applicable rule that both accurately predicts the killing power of a round and is simple enough for a hunter, soldier, or law enforcement officer to determine in conditions of tactical stress is a summation of the bullet's energy and the bullet's velocity at the given target range must exceed a minimum threshold for the game type. Further, for convenience, I have found that dividing game into 3 to 5 categories, from small and easy to kill to large and difficult to kill, further improves the ability of the shooter under mental stress to make the kill power determination.

In practice, I have found that the following equation is generally accurate for all 330 known rounds of ammunition for rifles, where KT is the target killing factor, v is the velocity of the round in feet-per-second, e is the energy of the round in foot-pounds, and d is the distance of the bullet from the muzzle of the rifle (typically in yards):

$$KT=\text{mag}[v(d)]+\text{mag}[e(d)] \quad \text{Eq. 1}$$

where mag[a] is a function to take the unitless magnitude of the value a.

Any bullet having a KT factor greater than 2200 found by adding the magnitudes (without units) of the energy of the bullet and the velocity of the bullet at a given range d is likely to kill an animal in one or more animal categories, for example. This allows for variations in bullet weight, ballistic coefficient, powder charge, etc., to be considered without expressly or explicitly requiring the shooter to refer to complicated ballistics tables, make calculations in his or her head, or use even more complicated tables, all while under stress.

So, in one embodiment of the present invention, hypothetical target animals can be divided into 5 classes, as shown in Table 1.

TABLE 1

Example KT Data Table

| Target Class | Animal Size | Example | $KT_{min}$ |
|---|---|---|---|
| I | small | varmints | 2200 |
| II | small-medium | bobcat | 3000 |
| III | medium | white tail deer | 3400 |
| IV | medium-large | mule dear | 4200 |
| V | large | elk, bear | 4500 |

So, using common ballistics tables which provide v(d) and e(d), one can calculate a new table for encoding into the new system's coefficients (43), such as that shown for a hypothetical round in Table 2.

TABLE 2

Example KT Data Table

| | | KT > $KT_{min}$ for T-Class @ d = | | | | | | | | |
|---|---|---|---|---|---|---|---|---|---|---|
| Round | Target Class | 100 | 200 | 300 | 500 | . . . | 700 | 800 | . . . | 1000 |
| .308 130 gr. | I | Y | Y | Y | Y | . . . | Y | Y | . . . | N |
| .308 130 gr. | II | Y | Y | Y | Y | . . . | Y | N | . . . | N |
| .308 130 gr. | III | Y | Y | Y | Y | . . . | N | N | . . . | N |
| .308 130 gr. | IV | Y | Y | Y | N | . . . | N | N | . . . | N |
| .308 130 gr. | V | Y | Y | N | N | . . . | N | N | . . . | N |

This table can be extended or modified for any round, using either commonly available ballistic table information for production ammunition, or using experimental information for custom ammunition. As such, the invention's tables and coefficients (43) can contain table entries for a single type of ammunition or for a wide range of ammunition.

To provide the user with a real-time indication of the likelihood of a one-shot, one-kill, the control processes (FIGS. 6*a* and 6*b*) for the reticle display (FIGS. 2, 5*a* and FIG. 5*b*) are enhanced to highlight a range marker bar or to providing an illuminated dot only when the entered target class is within a range for which KT is sufficient to kill the target animal.

To set up the scope, the user must initialize the scope by entering the intended target class, either by selecting a category, or by scrolling through a list of available animal types, and must enter the ammunition be used (if not defaulted to a single type of ammunition). Then, as the user engages the range finding operations, the control logic further consults the KT table (or alternatively a formula), and updates the display appropriately. For example, a red-colored dot may be displayed when $KT_{min}$ is not met to dissuade the shooter from taking the shot, and a green-colored dot may be displayed when $KT_{min}$ is met to indicate an acceptable shot can be made. Or, a flashing dot may indicate when $KT_{min}$ is not met, a continuously illuminated dot may indicate when $KT_{min}$ is met. Likewise, other symbols may be user—a dot for $KT_{min}$ being met, and an "X" or crossed-out circle for $KT_{min}$ not being met.

It is a further enhancement of the present invention to break shots into two types of kill shots—head shots and chest or body shots. Head shots, obviously, generally represent "smaller game" than the full body size of the target, unless the particular game has a well-armored head structure. Otherwise, if one is planning a head shot, and believes that he or she can meet the additional accuracy required to place a head shot (because most game have smaller heads than chests), the user can simply use a lower category of game for the KT indicator.

Bench Grouping Display

According to another aspect of the present invention, the scope display and control logic (41) is enhanced to receive and store information regarding a particular shooter's personal results in maintaining shot grouping, and then uses this information to show a likely region of impact when in the field.

For example, prior to going hunting, most shooters will take a rifle with a scope and some ammunition to a shooting range to "sight it" their scope. This is done to adjust the scope for differences in ammunition, and for slight, but considerable changes in the mechanical combination of the rifle and the scope. During sight in, the shooter will aim and shoot at a target at a known distance, usually 100 or 200 yards. When sighting in is completed, the shooter will be able to maintain a certain grouping of shots at the selected distance, and the scope settings are recorded or saved as a "zero".

Towards the end of this exercise, the shooter has achieved a certain level of performance, some due to the equipment (ammo, rifle, scope, sling, rest, bipod, etc.), but some due to the shooter himself.

According to this additional aspect of the present invention, the user first inputs a grouping criteria from a bench sighting-in session into the tables (43), which are stored and saved for later use by the logic (41). For example, a user may find at 200 yds that he or she can hold a 3-inch diameter grouping (e.g. all of his or her shots are placed within a 3-inch circle at 200 yards).

Figure 8:
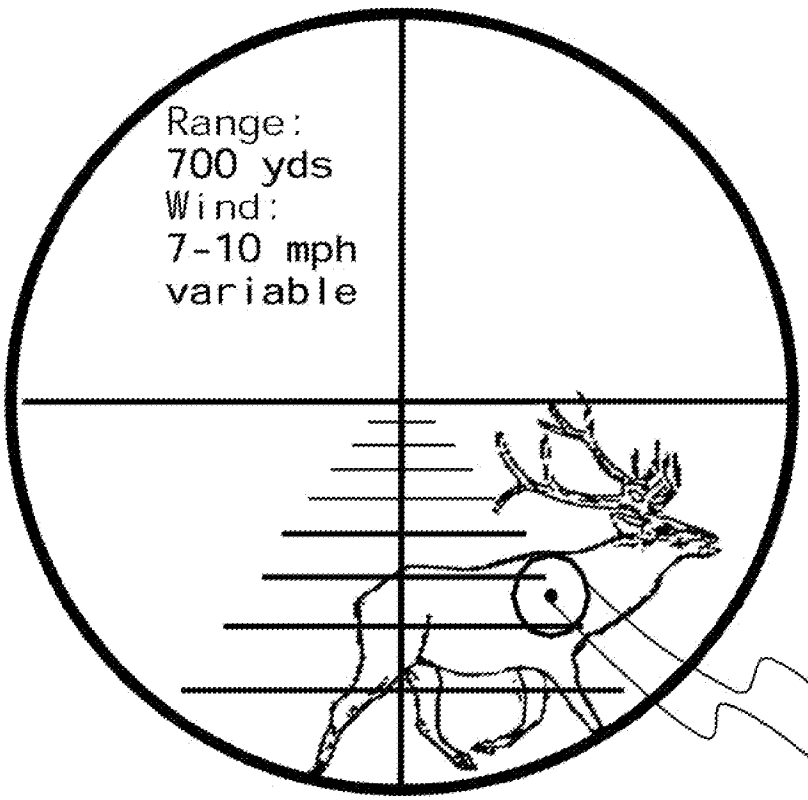
FIGS. 8*a* and 8*b* show enhanced aiming indicia based on grouping criteria from a bench sighting-in session.
Figure 8:
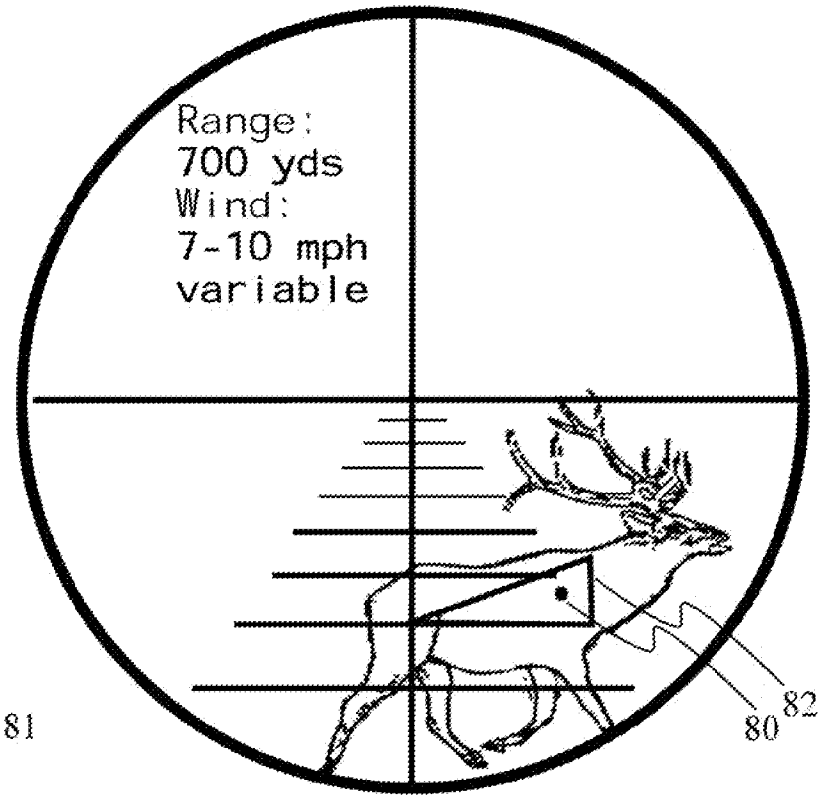

So, using the entry controls (105), the shooter can enter a range (200 yds in this example) and a grouping size (3 inches). Then, when using the scope in the field, the aiming dot (80) can optionally be replaced with or encompassed by a circle (81) of the appropriate size according to the user's bench group criteria, as shown in FIG. 8(*a*). In the present example, +/−1.5 inches at 200 yards correlates to a 0.75 MOA accuracy, which then can be plotted as a 0.75 MOA radius circle around where the aiming point is. At 100 yards, the circle would represent a 1.5 inch diameter area on the target. At a range of 700 yards, the shot group circle (81) would represent a 10½ inch diameter circle of likely shot placement on the target In this manner, the grouping circle will appear larger for greater ranges, while giving the shooter a realistic understanding of his or her ability to place the shot. This is a significant improvement, where standard aiming dots and crosshairs may lead a shooter to believe he or she can place a shot more accurately than practically possible for the shooter and the equipment.

Alternatively, other shapes, such as a triangular shape (82) can be placed around the aiming point (80) to represent the variation in crosswind values. This type of shape would be very useful in gusty wind conditions.

With this enhanced aiming indicia based on the user's practical performance, the user gets a more realistic idea of whether he or she will make the kill, so that the shot can be taken or aborted, as appropriate.

CONCLUSION

The foregoing examples are provided in order to illustrate the invention, but do not represent the scope and limits of the invention itself. It will be recognized by those skilled in the art that alternative embodiments, manners of usage, and combinations of optional features can be realized without departing from the spirit and scope of the present invention. For this reason, the scope of the present invention should be determined by the following claims.

I claim:

1. A telescopic gun sight having an optical system comprising:

a forward objective lens element;

a rear eyepiece lens element;

an intermediate erector lens element;

said lens elements being aligned along an optical axis constituting a line of sight and protectively confined within an elongated tubular housing adapted to be securely affixed to an ordnance firing device; and a substantially transparent reticle between said objective and erector lens elements, said reticle having two interconnected grids, a first being a distance-measuring grid constructed of an electrified grid which illuminates a selected intersection to produce an aiming dot, which aiming dot grid is not visible to a shooter except for the aiming dot and which is interconnected to a second reticle having ballistic aiming indicia thereon, said indicia comprising a center vertical straight hairline and a center horizontal straight hairline, said center vertical and center horizontal hairlines intersecting substantially perpendicularly, and a series of primary range-marker indicia disposed below said center horizontal hairline, the vertical spacing of said primary range-marker indicia below said center horizontal hairline being non-evenly spaced and proportional to drop of said ordnance at selectively increased target ranges dependent upon the substantially parabolic flight of real projectiles fired in earth's gravitational field, wherein the spacing of said range-marker indicia below said horizontal center hairline is determined at the gun sight's highest power at one or two hairlines or one and two and three hairlines or one and two and three and four hairlines or one and two and three and four and at least one additional hairlines in a range of −1.2 to −18 inches of subtention at 100 yards, respectively, and at the gun sight's lowest power at one or two hairlines or one and two and three hairlines or one and two and three and four hairlines or one and two and three and four and at least one additional hairlines in a range of −8 to −103 inches of subtention at 100 yards, respectively.

2. The system according to claim 1 wherein the ordnance firing device is a rifle for shooting a bullet at a target.

3. The system according to claim 1 wherein the electrified grid comprises a fine platinum or tungsten wire grid.

4. The system according to claim 1 wherein the aiming dot is a red dot.

5. The system according to claim 1 wherein said series of primary range-marker indicia comprises a series of primary straight horizontal range-marker hairlines disposed below said center horizontal hairline and substantially parallel thereto and in vertically bisected relationship with said center vertical hairline.

6. The system according to claim 5 wherein said series of primary straight horizontal hairlines has sequentially increasing incremental lengths with an intersected shaded series of range-marker hairlines of sequentially increasing incremental lengths disposed below said center horizontal hairline having angled wind markers set at 96 and 106 degree angles for right side hairlines and 186 and 196 degree angles for left side hairlines.

7. The system according to claim 1 wherein other spacing ratios are applied to specific other types of ordnance firing devices and loads and further comprising a decal providing a representation of the reticle for use with the gun sight and matching a first set of predetermined ranges and a second set of predetermined ranges for all incremental aiming indicia so located upon the reticle.

8. The system according to claim 2 wherein the rifle comprises a rifle stock and further comprising a keypad disposed in the rifle stock, a connection from the keypad to a disk in the gun sight tubular housing, and the disk connected to a minute of angle grid comprising an electronically connected reticle displaying a lens imprinted with a set of ballistic indicia.

9. The system according to claim 1 wherein the system further comprises:

means for inputting selected data for y-axis height of a target in inches;

means for correcting for wind drift;

means for correcting for phenomena associated with gyroscopic forces on a gyroscopically stabilized bullet including Yaw of Repose and Magnus effects;

means for correcting for uphill or downhill angle of a shot;

means for correcting for elevation;

means for correcting for air temperature;

wherein said inputting and correcting is performed in accordance with Mental Ballistics Calculator calculations; and further comprising:

means for compensating for ordnance firing device barrel temperature; and means for changing a power ring to equate the energy of maneuverability of a specific one of 335 cartridges to be shot by the ordnance firing device;

wherein the disk computes an intersection of the grid, wherein changing conditions are reflected as an aiming dot on the connected reticle which displays the lens imprinted with a set of ballistic indicia.

10. A telescopic gun sight having an optical system comprising:

a forward objective lens element;

a rear eyepiece lens element;

an intermediate erector lens element;

said lens elements being aligned along an optical axis constituting a line of sight and protectively confined within an elongated tubular housing adapted to be securely affixed to an ordnance firing device; and a transparent reticle between said objective and erector lens elements, said reticle having two interconnected grids, a first being a distance-measuring grid constructed of an electrified grid which illuminates a selected intersection to produce an aiming dot, which aiming dot grid is not visible to a shooter except for the aiming dot and which is interconnected to a second reticle having ballistic aiming indicia thereon, said indicia comprising a center vertical straight hairline and a center horizontal straight hairline, said center vertical and center horizontal hairlines intersecting substantially perpendicularly, and a series of primary range-marker indicia disposed below said center horizontal hairline, the vertical spacing of said primary range-marker indicia below said center horizontal hairline being non-evenly spaced and proportional to drop of said ordnance at selectively increased target ranges dependent upon the substantially parabolic flight of real projectiles fired in earth's gravitational field, wherein said target ranges are one or more yardages in a range of 100 yards to 1,000 yards or a combination of said yardages within said range, respectively.

11. The system according to claim 10 wherein the ordnance firing device is a rifle for shooting a bullet at a target or any similar piece of ordnance designed to propel a spin stabilized projectile.

12. The system according to claim 10 wherein the electrified grid comprises a fine platinum or tungsten wire grid.

13. The system according to claim 10 wherein the aiming dot is a red dot or any distinctive indicium which performs a substantially instantaneous mnemonic aiming function.

14. The system according to claim 10 wherein said series of primary range-marker indicia comprises a series of primary straight horizontal range-marker hairlines disposed below said center horizontal hairline and substantially parallel thereto and in vertically bisected relationship with said center vertical hairline.

15. The system according to claim 14 wherein the lengths of said range-marker hairlines on either side of the center vertical hairline are in the order of 2.06, 2.95, 4.16, and 4.86 or greater or smaller distal proportion, wherein said proportions correspond to a 30/06 type bullet to correct for an incremental horizontal movement which could be more or less for a crosswind of 10 miles an hour to correct for a crosswind of 10 miles an hour and also stronger crosswinds in increments of 10 miles an hour to facilitate correction for vertical movement of the ordnance defined as gyroscopic precession measured in inches of subtention at 100 yards being at a normal angle of 6 degrees and graduating to a major angle of 16 degrees.

16. The system according to claim 10 wherein other incremental ranges are selected for other types of missions employing longer range guns and predetermined loads.

17. The system according to claim 10 wherein other lengths are used for specific other applications and further comprising a decal providing a representation of the reticle for use with the gun sight and matching a first set of predetermined ranges and a second set of predetermined ranges for all incremental aiming indicia so located upon the reticle.

18. A telescopic gun sight having an optical system comprising:

a forward objective lens element;

a rear eyepiece lens element;

an intermediate erector lens element;

said lens elements being aligned along an optical axis constituting a line of sight and protectively confined within an elongated tubular housing adapted to be securely affixed to an ordnance firing device; and a transparent reticle between said objective and erector lens elements, said reticle having two interconnected grids, a first being a distance-measuring grid constructed of an electrified grid which illuminates a selected intersection to produce an aiming indicium comprising an aiming dot, which aiming dot grid is not visible to a shooter except for the aiming dot and which is interconnected to a second reticle having ballistic aiming indicia thereon, said indicia comprising a center vertical straight hairline and a center horizontal straight hairline, said center vertical and center horizontal hairlines intersecting substantially perpendicularly, and a series of primary range-marker indicia disposed below said center horizontal hairline, the vertical spacing of said primary range-marker indicia below said center horizontal hairline being non-evenly spaced and proportional to drop of said ordnance at regularly increased target ranges dependent upon the substantially parabolic flight of real projectiles fired in earth's gravitational field, wherein said series of primary range-marker indicia comprises a series of primary straight horizontal range-marker hairlines disposed below said center horizontal hairline and substantially parallel thereto and in vertically bisected relationship with said center vertical hairline, said series of primary straight horizontal hairlines having sequentially increasing incremental lengths with an intersected shaded series of range-marker hairlines of sequentially increasing incremental length disposed below said center horizontal hairline having angled wind markers set at 96 and 106 degree angles for right side hairlines and 186 and 196 degree angles for left side hairlines, and wherein the lengths of said range-marker hairlines on either side of said center hairline are specific multiples of 2.06, 2.95, 4.16, and 4.86 inches of subtention at 100 yards, respectively, and wherein specific multiples of said lengths indicate specific wind speed, moving target lead, or a combination of wind speed and moving target lead corrections.

19. The system according to claim 18 wherein the ordnance firing device is a rifle for shooting a bullet at a target.

20. The system according to claim 18 wherein the electrified grid comprises a fine platinum or tungsten wire grid.

21. The system according to claim 18 wherein the aiming dot is a red dot.

22. The system according to claim 18 further comprising a decal providing a representation of the reticle for use with the gun sight and matching a first set of predetermined ranges and a second set of predetermined ranges for all incremental aiming indicia so located upon the reticle.

23. The system according to claim 1 wherein the spacing of said range-marker indicia below said horizontal center hairline is determined at the gun sight's highest power at one or two hairlines or one and two and three hairlines or one and two and three and four hairlines or one and two and three and four and at least one additional hairlines at −1.2, −3, −4.6, −6.7, −9, −12, −15, −18 inches of subtention at 100 yards, respectively, and at the gun sight's lowest power at one or two hairlines or one and two and three hairlines or one and two and three and four hairlines or one and two and three and four and at least one additional hairlines at −8, −17, −28, −41, −54, −69, −86, −103 inches of subtention at 100 yards, respectively.

24. The system according to claim 10 wherein said target ranges are one or more yardages comprising 100 yards, 200 yards, 300 yards, 400 yards, 500 yards, 600 yards, 700 yards, 800 yards, 900 yards, and 1,000 yards or a combination of said yardages, respectively.

* * * * *